United States Patent [19]

Rodgers

[11] Patent Number: 4,884,895

[45] Date of Patent: Dec. 5, 1989

[54] PAINT STIRRER

[76] Inventor: Leroy Rodgers, 665 E. Jarvis, Des Plaines, Ill. 60018

[21] Appl. No.: 159,749

[22] Filed: Feb. 24, 1988

[51] Int. Cl.[4] ..... B01F 13/00

[52] U.S. Cl. ..... 366/343; 15/164; 366/605

[58] Field of Search ..... 366/343, 605, 309, 129; 15/166, 164, 165, 192, 193

[56] References Cited

U.S. PATENT DOCUMENTS

| | | | |
|---|---|---|---|
| 1,732,714 | 10/1929 | Copes | 366/605 |
| 1,775,457 | 9/1930 | Hansen | 366/605 |
| 2,703,899 | 3/1955 | Bledsoe | 15/160 |

FOREIGN PATENT DOCUMENTS

| | | | |
|---|---|---|---|
| 432375 | 8/1926 | Fed. Rep. of Germany | 15/166 |
| 682246 | 11/1952 | United Kingdom | 15/166 |

*Primary Examiner*—Robert W. Jenkins

*Attorney, Agent, or Firm*—Basil E. Demeur; Robert E. Knechtel; Alan B. Samlan

[57] ABSTRACT

There is disclosed an improved paint stirrer especially adapted for stirring paints of the type having pigments normally held in colloidal suspension, which pigments settle out of colloidal suspension with time, formed by an elongate body portion having an upper end and a lower end, the upper end provided with a hand grip section formed integrally with the elongate body portion, the lower end of the elongate body portion provided with flexible stirring means fixedly secured thereto and formed by a plurality of flexible and pliable members thereby to contact paint pigments which have settled out of colloidal suspension and to replace the pigments into colloidal suspension prior to the use of the paint.

1 Claim, 1 Drawing Sheet

PAINT STIRRER

BACKGROUND OF THE INVENTION

It is well known in the paint field that many different formulations of paints have been developed for specific purposes and uses. In this connection, it is well known that paint technology now provides paints which contain various types of pigments which are generally held in the paint by colloidal suspension. These paints include, for example, metallic paints, acrylic lacquers, stains, and other such paints which includes pigments. It is therefore obvious that in order for the paint to be properly applied at the time of use, the pigments must be properly distributed in colloidal suspension in order to achieve the desired painted result.

It is also well known that the consumer market for paints generally dictates that paints be sold in containers of one gallon or less in volume, and that prior to use, the paint be capable of being stirred thoroughly, for the purpose of either mixing the paint solutions together, or in the case of pigmented paints, in order to re-distribute the pigments which have fallen out of colloidal suspension in order for the proper result to be achieved.

Heretofore, there has been very little development in the art of paint stirrers, other than providing the consumer with a wooden stick or paddle to use as a stirrer prior to utilizing the paint. In connection with pigmented paints, it has now been found that the typical solid elongate paint stirrer or paddle does not function to properly return or replace the pigments which have fallen out of colloidal suspension back into suspension prior to use. Indeed, especially with metallic paints, it has been found that stirring the paint prior to use with a simple wooden paddle or stick does not return a sufficient proportion of the pigments back into suspension such that when the paint is applied, the desired metallic painted effect is not completely realized. The result is that the paint, once applied to a surface, is not uniform in terms of appearance, and does not usually result in the desired effect intended to be achieved.

Further typical of the current state of the art in terms of paint stirrers is the use of mechanical shakers for mixing paint at the time of purchase. It is common knowledge that when the consumer purchases a can of paint, then the can is first placed on a mechanical shaker in order to fully mix the paint which has separated, or in the alternative, to re-distribute colloidal suspension. However, such mechanical shakers are only applicable with respect to the cans of paint when the same are purchased new for the reason that once the can has been opened, it is virtually impossible to replace the lid on the container so that a mechanical shaker can be employed. Hence, it has been found that with paint such as the metallic paints, once the can has been opened, and the paint utilized for approximately two hours or more, the pigments begin to separate out of suspension. Any attempt to replace the lid on the ca for the purpose of utilizing a mechanical shaker is virtually impossible. It has been found that the lids will not remain in position, and if the attempt is made to use a mechanical shaker, the lids generally will come loose with the result that the paint will spill from the can. Hence, where paints such as metallic paints or other pigmented paints are utilized, once the can is open and the particular project is not completed after two hours, the balance of the paint remaining in the can is usually discarded.

It has further been found that where paints such as metallic paints, acrylic lacquers or stains are involved, the mechanical paint shakers do not generate the proper action in order to place the pigments into colloidal suspension. It has been found that the violent shaking incident to the mechanical shakers does not provide the proper action in order to re-distribute colloidal particles or pigments back into colloidal suspension.

Typical of prior art paint stirrers are shown in older patents such as Pat. No. 1,732,714 or in paint stirrers provided which consist of a paddle formed of wood, and as shown in the aforesaid patent, the lower portion of the stirrer consists of a slotted blade portion to aid in the function of mixing. The intended function of the slotted blades is to function in the same manner as a comb-like formation at the stirring end of the paddle, the expectation being that that construction will aid in the mixing function or stirring function of the device. However, even with solid wood paint stirrers of the type shown and described therein, it has been found that the solid wood paddles, even when slotted, will not agitate the pigments back into colloidal suspension prior to use. It must be appreciated that the pigments are extremely small particles, and therefore, difficult to replace into a colloidal suspension. Hence, paint stirrers of the type disclosed in Pat. No. 1,732,714 do not achieve the desired result.

Another prior art U.S. Pat. No. 1,775,457 discloses a mixing device for mixing paints, wherein the mixer is provided with an arm resting adjacent the bottom of the container, which arm is denoted as a stirring blade and includes a brush portion extending downwardly therefrom which, in use, is adjacent the bottom of the mixing container. It will be noted however, that the subject mixing device as disclosed therein is intended in a commercial application, and includes an arm intended for accomplishing the vertical reciprocation of the mixing arm within the container. As indicated in the aforementioned patent, the brush portion basically functions to clean the bottom of the container during the stirring operation, and is not utilized for the purpose of mixing the pigmented portions of the paint.

As indicated previously, the paint art has advanced to the point where metallic paints, acrylic lacquers and the like now are sold in great volume, and the ability to re-use these paints when stored in containers is hampered by the fact that there is not available a stirring device which can achieve the thorough mixing of the pigments back into colloidal suspension once they have settled out toward the bottom of the container. Hence, the principal object of the present invention is to provide an improved paint stirrer which is especially adapted for use in conjunction with pigmented paints, such as metallic paints, iridescent paints, acrylic lacquers, stains and the like.

OBJECTS AND ADVANTAGES

It is the principal object of the present invention to provide an improved paint stirrer device adapted for stirring paints which include pigments normally held in colloidal suspension, but which pigments settle out of colloidal suspension with time, the improved paint stirrer being formed by an elongate body portion having an upper end and a lower end, the upper end provided with a hand grip section integral with the elongate body portion, the lower end thereof provided with flexible stirring means fixedly secured thereto, the flexible stirring means including a plurality of flexible and pliable members intended to contact the paint pigments during the stirring process, which have settled out of colloidal suspension thereby to replace the pigments back into colloidal suspension prior to use of the paint.

In conjunction with the foregoing object, it is a further object of the present invention to provide an improved paint stirrer of the type described wherein the flexible and pliable members comprise a plurality of brush bristles fixedly secured to the lower end of the elongate body portion and spaced a short distance apart, thereby to contact and excite the pigments back into colloidal suspension prior to use.

In conjunction with the foregoing objects, it is yet a further object of the invention to provide an improved paint stirrer of the type described wherein the proportionate length of the brush bristle portion of the stirrer relative to the elongate body portion does not exceed a ratio of approximately 1:12 and wherein the bristles themselves do not exceed one-half inch in length.

Still a further object of the present invention is to provide an improved paint stirrer of the type described above, wherein the preferred embodiment of the invention, the brush bristles are formed of a plastic material thereby to achieve the greatest degree of flexibility and pliability of the members incident to the stirring operation.

Further features of the invention pertain to the particular arrangement of the parts whereby the above outlined and additional operating features thereof are attained.

The invention, both as to its organization and method of operation, together with further objects and advantages thereof will best be understood by reference to the following specification taken in connection with the accompanying drawings.

SUMMARY OF THE INVENTION

In summary, the present invention contemplates an improved paint stirrer especially useful and adapted for accomplishing the stirring or mixing operation of pigmented paints, such as metallic paints, acrylic lacquers, stains and the like, wherein the paint includes pigment particles held in colloidal suspension in the paint, for the purpose of achieving the desired painted result. The improved paint stirrer of the present invention is intended to accomplish the function of replacing the pigments which have settled out of colloidal suspension back into colloidal suspension incident to the stirring and mixing operation thereby to permit the paint to achieve the desired result when applied to the underlying surface.

DETAILED DESCRIPTION OF INVENTION

Figures 1, 2, 3:
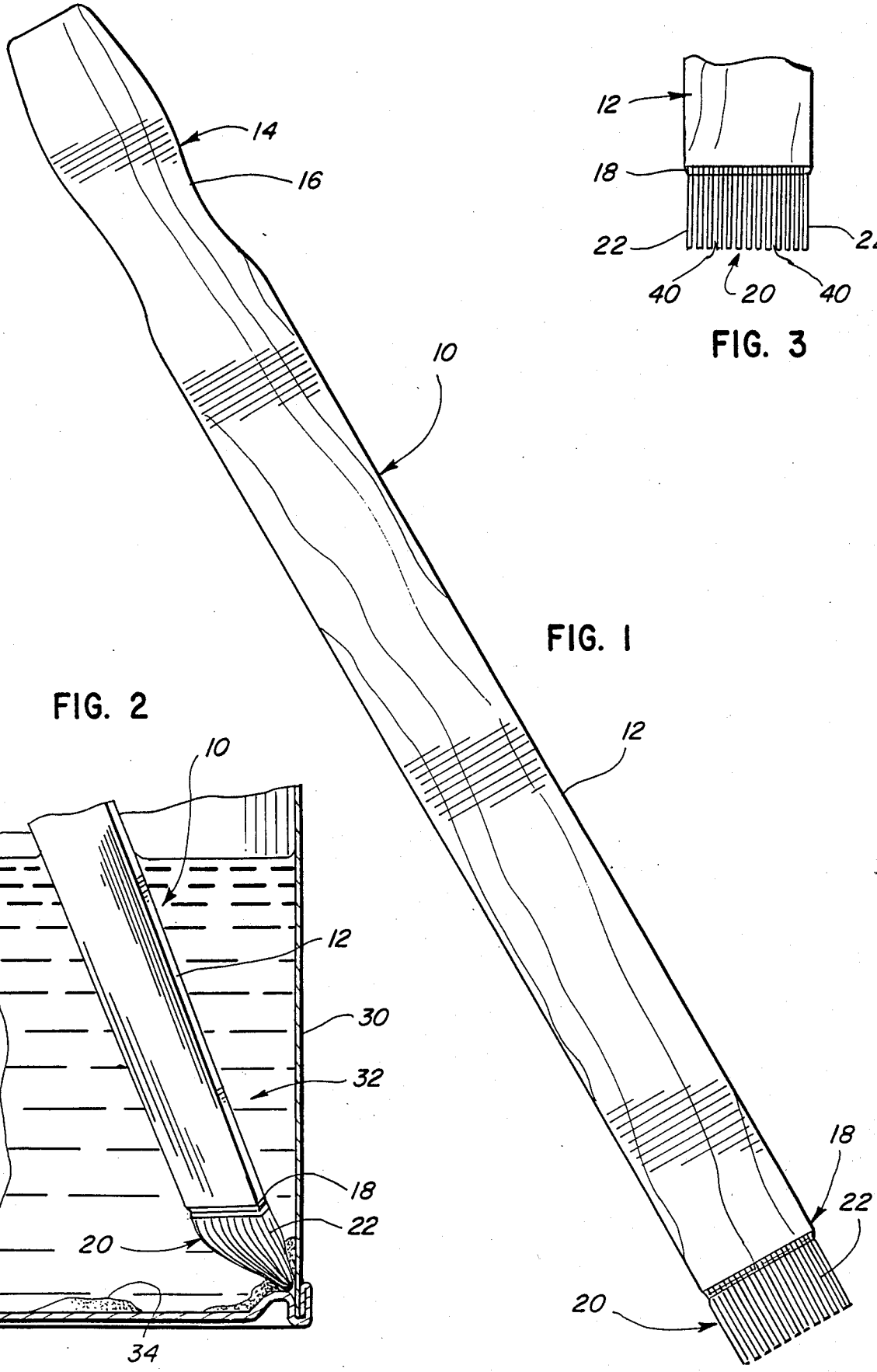
FIG. 1 is a full top view of the subject paint stirrer of the present invention showing the elongate body portion and the pliable and flexible stirring members fixedly secured to the lower end thereof.
FIG. 2 is a side elevational view, partly in cross-section, showing the manner in which the bristled paint stirrer of the present invention functions to agitate the pigments present in the paint back into colloidal suspension.
FIG. 3 is a front elevational view, partly broken away, showing the construction and configuration of bristles in spaced apart relationship as mounted to the stirrer.

As illustrated in FIG. 1 of the drawings, the paint stirrer 10 of the present invention is shown to be formed from an elongate body portion 12, which includes an upper end 14 provided with a hand grip section 16, and a lower end 18, provided with flexible stirring means 20. The elongate body portion 12 is formed from a rigid material such as wood or plastic, and is intended to be sufficiently rigid in order to accomplish the typical and normal stirring function for paints and the like. The hand grip section 16 is formed in the manner of prior art stirrers, providing a convenient gripping portion for the hand of the user.

As illustrated in FIGS. 1 and 2 of the drawings, the lower end 18 of elongate body portion 12 is provided with the flexible stirring means 20, which, in the preferred embodiment, is formed by a plurality of brush bristles 22. As particularly shown in FIG. 2 of the drawings, the brush bristles 22 are sufficiently pliable and flexible in order to reach into corners of the paint container 30. As exemplified in FIG. 2, the paint 32 contained within the container 30 is of the type which includes a plurality of pigments 34 generically known as a pigmented paint. Such paints include metallic paints, acrylic lacquers, stains, and other such suspensions wherein the paint is intended to achieve a certain result. Again as shown in FIG. 2 of the drawings, it is well known that as the paint container 30 stands for long periods of time, generally over two (2) hours, the pigments 34 have a tendency to settle out of colloidal suspension toward the bottom of the container 30. By providing the paint stirrer 10 with flexible stirring means 20, pigments 34 may be agitated back into colloidal suspension incident to the stirring process.

In the preferred embodiment, the flexible stirring means 20 is formed by a plurality of brush bristles 22 in order to thoroughly and adequately agitate the pigments 34 back into suspension. Furthermore, it has been found that if the bristles 20 are formed of a synthetic resin material, such as nylon for example, the process of replacing the pigments 34 back into suspension is enhanced, while at the same time, enhancing the life of the paint stirrer 10. It will be obvious that by utilizing plastic brush bristles 22, regardless of the particular paint, lacquer or stain employed, the stirrer including the brush bristles 22 may be easily cleaned by any type of paint solvent or thinner such that the stirrer may be re-used on numerous occasions.

FIG. 3 of the drawings shows a more detailed view of the lower portion 18 of the stirrer 10 and shows that the bristles 22 are spaced apart from each other a short distance, denoted by the numeral 40. The spacing apart of the bristles 22 is essential with respect to the present invention, since it permits the pigments to pass between the bristles incident to the stirring process. This is contradistinguished from a paint brush wherein the bristles are bunched together since the intention with a paint brush is to keep the bristles as close together as possible so that the paint may be picked up by the brush for application to an underlying surface. It is further to be noted that the bristles 22 may either be single bristles, or in the preferred embodiment, are generally formed by a bristle bunch, each bunch 22 being spaced apart a short distance 40 from the next adjacent bunch.

It will further be noted that the present invention contemplates that the relative proportionate length of the flexible stirring means 20 relative to the entire overall length of the elongate body portion 12, as particularly shown in figure 1 of the drawings represents a ratio of approximately 1:12. This relative proportion is sufficient to accomplish the agitation process in order to agitate the pigments 34 back into suspension, while at the same time minimizing the cleaning operation in order to re-use the stirrer on numerous occasions. Hence, by maintaining a relatively short length of the flexible stirring means 20 relative to the overall length of the stirrer 10, the cleaning operation for cleaning the brush bristles 22 is minimized.

It is further to be noted that the overall length of the bristles should not exceed one-half inch in length for proper stirring and agitation purposes. It has been found that bristles in excess of one-half inch do not achieve the proper stirring action, in terms of properly redistributing the pigments back into colloidal suspension.

It will further be appreciated that by providing the relatively rigid paint stirrer with a flexible lower end, and especially the brush bristle portion at the lower end, the ability to stir the entire paint formulation, while at the same time agitating the precipitated pigments 34 back into suspension is greatly enhanced. It will be appreciated that a solid stirrer, that is, solid from top to bottom, is not capable of reaching into the corners of the container 30, incident to the stirring process, in order to agitate the pigments 34 properly back into suspension. Hence, the stirrer of the present invention clearly demonstrates that it is ideally suited and adapted for mixing modern paints which are pigmented, such as metallic paints, lacquers, stains, acrylic lacquers, and the like.

The paint stirrer of the present invention may be manufactured in different sizes in order to accommodate different sized paint containers. It will be appreciated that the overall length of the paint stirrer is not particularly relevant so long as the size requirements of the bristles is maintained. As indicated previously, the bristles should not exceed one-half inch in length, although the ratio of the flexible stirring means 20 to the elongate body portion 12 which was indicated to be in the range of 1:12 may be varied in order to manufacture a stirrer suitable for quart or pint containers.

While there has been provided what is at present considered to be a preferred embodiment of the invention, it will be understood that various modifications may be made therein and it is intended to cover in the appended claims all such modifications as fall within the true spirit and scope of the invention.

I claim:

1. An improved paint stirrer adapted for stirring paints which include pigments normally held in colloidal suspension, but which pigments settle out of colloidal suspension with time, the improvement comprising in combination, an elongate body portion having an upper end and a lower end, said upper end provided with a hand grip section integral with said elongate body portion, said lower end of said elongate body portion provided with flexible stirring means fixedly secured thereto, said flexible stirring means formed by a plurality of flexible and pliable members thereby to contact the paint pigments which have settled out of colloidal suspension to replace the pigments into colloidal suspension incident to the stirring process, said flexible and pliable members consisting of a plurality of brush bristles fixedly secured at said lower end of said elongate body portion and in spaced apart relationship to permit the pigments to pass between the bristles, said brush bristles having a proportionate length relative to said elongate body portion which does not exceed a ratio of approximately 1:12, and said brush bristles having an overall length which does not exceed one-half inch.

* * * * *